United States Patent [19]

Fassbinder

[11] Patent Number: 4,561,466

[45] Date of Patent: Dec. 31, 1985

[54] VALVE FOR SUPPLYING FLOW MEDIA

[75] Inventor: Hans-Georg Fassbinder, Sulzbach-Rosenberg, Fed. Rep. of Germany

[73] Assignee: Kloeckner Stahlforschung GmbH, Fed. Rep. of Germany

[21] Appl. No.: 439,283

[22] Filed: Nov. 4, 1982

[30] Foreign Application Priority Data

Nov. 4, 1981 [DE] Fed. Rep. of Germany ..... 3143795

[51] Int. Cl.[4] ..... F16K 31/12

[52] U.S. Cl. ..... 137/614.21; 137/614.2; 137/536; 251/30.01; 251/41; 251/43

[58] Field of Search ..... 137/614.2, 614.21, 536, 137/541; 251/30, 41, 43

[56] References Cited

U.S. PATENT DOCUMENTS

| | | | |
|---|---|---|---|
| 1,630,666 | 5/1927 | McEvoy, Jr. | 137/536 |
| 2,970,806 | 2/1961 | Roxford et al. | 137/614.21 |
| 3,035,609 | 5/1962 | Dyer | 137/614.21 |
| 3,171,432 | 3/1965 | Bard | 251/43 |
| 3,399,689 | 9/1968 | Keane | 251/30 |

FOREIGN PATENT DOCUMENTS

| | | | |
|---|---|---|---|
| 1529109 | 6/1970 | Fed. Rep. of Germany | 137/614.21 |

*Primary Examiner*—A. Michael Chambers
*Attorney, Agent, or Firm*—Robert J. Koch

[57] ABSTRACT

The valve for supplying a flow medium to a flow medium pipe which alternatingly carries different flow media, in particular to the flow medium pipe of a converter for treating the contents of a converter with various gaseous flow media, exhibits a chamber (20) between the flow medium inlet (7) and the flow medium outlet (10), which chamber may be closed on the side facing the flow medium inlet (7) by a piston (11) and on the side facing the flow medium outlet (10) by a disk (12). The piston (11), on the side turned away from the chamber (20), and the chamber (20) are optionally connectable via separate flow medium pipes (27 and 28, respectively) with the flow medium inlet (7) and the free atmosphere, respectively, to close the chamber (20) by the piston (11) and evacuate the chamber, or with the free atmosphere and the flow medium inlet (7), respectively, to open the chamber (20) by the piston (11). The disk (12) is loaded in a closed position towards the chamber (20) by a spring (13) and a differential piston (14) with a larger effective surface (14') on the side facing the flow medium outlet (10) and a smaller effective surface (14'') on the opposite side (the only drawing).

16 Claims, 1 Drawing Figure

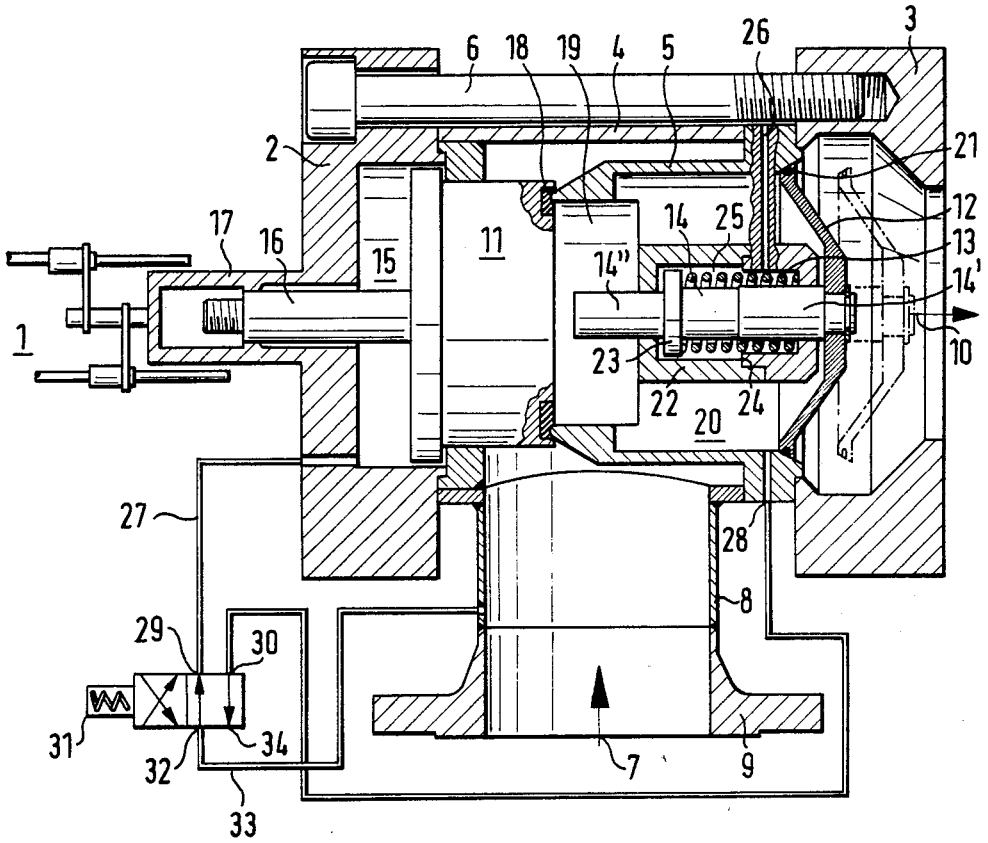
6
18
19
4
5
26
3
2
21
12
13
14'
10
17
16
15
11
14
25
14"
1
23
22
24
20
27
28
8
29
30
31
32
34
33
7
9

VALVE FOR SUPPLYING FLOW MEDIA

The invention relates to a valve of the species stated in the introductory part of claim 1.

Flow medium pipes which alternatingly carry at least two different flow media, namely only one during a certain period of time and the other during another period of time, are expected to allow for the pressure of each flow medium to be kept constant within the flow medium pipe.

This is especially true of flow medium pipes which are used, for example, to supply converters for steel production with gaseous suspensions or suspensions of carrier gas and solids to treat the melting charge. In this manner, for example, the jets below the surface of the electrolyte of a converter may be charged with inert gas or oxygen with or without slag-forming constituents. A pressure drop in these jets in the converter would necessarily cause the melting charge to penetrate the blast pipes, thus clogging the jets and damaging the supply devices and pipes of the jets.

In order to meet the above-mentioned demands it is known to arrange a first check valve, a breather space, a second check valve and a back valve opening away from the oxygen inlet, after the oxygen inlet, in the case of flow medium pipes which alternatingly carry oxygen and other gaseous flow media. The breather space between the two check valves is provided with a third check valve to connect the breather space with the free atmosphere, if desired. This procedure requires a relatively large number of piece parts, quite a lot of space and is relatively elaborate.

The invention is based on the problem of eliminating these disadvantages in particular and providing a valve of the species stated in the introductory part of claim 1, having a simple construction, reliably meeting the above-mentioned demands in particular, and fulfilling all the described functions at the same time.

This problem is solved by the features stated in the characterizing part of claim 1. Advantageous embodiments of the inventive valve are characterized in the remaining claims.

In the following, an embodiment as shown in FIG. 1 of the inventive valve shall be described by way of example with reference to the drawing, which shows a longitudinal section on the plane on which the flow medium inlet and the flow medium outlet of this valve are provided.

The valve exhibits a housing 1 comprising two lids 2 and 3 and a pipe-like central portion 4. Central portion 4 is fixed together with an inner sheath 5 between the two lids 2 and 3 which are connected with each other by screws 6.

The flow medium inlet 7 of the valve, which is formed by a pipe socket 8 on central portion 4 and is provided at its free end with a fitting flange 9, extends perpendicular to the longitudinal axis of housing 1. Flow medium outlet 10 of the valve is arranged coaxially to the longitudinal axis of housing 1 and is designed in the lid 3 located on the right in the drawing.

The valve further exhibits a step piston 11, a disk 12, a pressure spring 13 and a differential piston 14. Step piston 11, disk 12 and differential piston 14 are arranged coaxially to each other and to the longitudinal axis of housing 1, as is sheath 5.

Step piston 11 is housed mobilely in a chamber 15 which is designed in the lid 2 on the left in the drawing.

Its piston rod 16 is taken up in a cup-shaped extension 17 of lid 2. Step piston 11 cooperates on the (in the drawing) right-hand face of its section with a smaller diameter, with an annular edge 18 of sheath 5, in order to close the adjacent opening 19 in the chamber 20 surrounded by sheath 5 which extends between flow medium inlet 7 and flow medium outlet 10.

Disk 12 is mobilely arranged in flow medium outlet 10 of the valve between the closed position, shown in unbroken lines, and the open position, indicated by dot-dash lines. It is attached at the end of differential piston 14 shown on the right in the drawing, and loaded by this piston and pressure spring 13 towards the left into the closed position, in which its outer periphery lies against a conical seating 21 of sheath 5 in order to seal off chamber 20 on the side facing flow medium outlet 10 of the valve.

Differential piston 14 extends through a housing 22 provided in the middle of chamber 20 and connected with sheath 5, travelling through the wall of the housing facing flow medium outlet 10 of the valve with a section 14' with a larger diameter, and through the other wall of the housing facing chamber opening 10 with a section 14" with a smaller diameter, so that its effective surface is greater on the side facing flow medium outlet 10 than the opposite effective surface on its other side adjacent to chamber opening 19 and step piston 11. Within housing 22 differential piston 14 is provided with a collar 23 which cooperates with an inner ring shoulder 24 of housing 22 to limit the movement of differential piston 14 towards the right, in the drawing, and thus define the open position of disk 12, indicated by dot-dash lines. Further, pressure spring 13, which is located in housing 22 and lies against the other end of the wall of housing 22 shown in the drawing on the right, adjacent to disk 12, is supported by collar 23. The inside 25 of housing 22 communicates with the free atmosphere via a flow medium pipe 26.

Flow medium pipes 27 and 28 open out into chamber 15 of step piston 11 and chamber 20, respectively, in the area of the front wall of the chamber, on the left in the drawing, and in the area beside the conical seating 21 of sheath 5. The two flow medium pipes 27 and 28 are connected to outflows 29 and 30, respectively, of an electromagnetic 4-way valve 31, one inflow 32 of which is connected with flow medium inlet 7 of the valve by means of a flow medium pipe 33, the other inflow 34 communicating with the free atmosphere.

The valve functions in the following manner. In an open state, the flow medium, e.g. oxygen, which is supplied in the flow medium pipe attached to fitting flange 9, flows from flow medium inlet 7 of the valve to its flow medium outlet 10, in order to enter the flow medium pipe attached to lid 3, leading to a converter whose contents are to be treated by the flow medium, which is blown into the converter or its contents through jets on the bottom. Electromagnetic 4-way valve 31 is in the switch position, shown on the left in the drawing, so that chamber 15 of step piston 11 is evacuated and the bypass formed by flow medium pipes 28 and 33 is open between flow medium inlet 7 of the valve and its chamber 20. Step piston 11 lies against the front surface of chamber 15, shown on the left in the drawing, pressed against it by the pressure of the flow medium located in housing 1 of the valve, so that chamber opening 19 is clear. Disk 12 also goes into the open position indicated in the drawing of FIG. 2 by dot-dash lines.

If the flow media in the common flow medium pipe should now alternate, i.e. downstream from flow medium outlet 10, one flowing flow medium, called "the first flow medium" in the following, is to be replaced by the other flow medium to be switched in, called "the second flow medium" in the following, the second flow medium is first switched into the common flow medium pipe, e.g. by means of a constructionally identical valve. As soon as this second valve (not shown) registers the "open" operating position by an appropriate contact, the valve shown is switched onto the closed state shown in the drawing.

The pressure in the common flow medium pipe is adjusted to the higher pressure of the two flow media as soon as the second flow medium is switched in, so that the pressure of one of the two flow media is always effective in the common flow medium pipe. If, for example, the pressure of the second flow medium is greater than that of the first, disk 12 closes valve chamber 20 and prevents the second flow medium from flowing into the valve for the first flow medium. When the pressure relations are reversed, disk 12 of the valve remains closed for the second flow medium until the pressure in the common flow medium pipe has dropped to the pressure of the second flow medium due to the closing process of the valve for the first flow medium.

The valve shown for the first flow medium is switched into the closed state shown in the drawing in the following manner to interrupt this flow medium pipe. Electromagnetic 4-way valve 31 is switched over to the switch position shown on the right in the drawing, so that now the flow medium pipe 27 leading into chamber 15 of step piston 11 communicates with flow medium inlet 7 of the valve by means of flow medium pipe 33, and its chamber 20 communicates instead with the free atmosphere by means of flow medium pipe 28. Step piston 11 is displaced towards sheath 5 andpressed against annular edge 18 by the pressure building up in chamber 15 and acting upon its larger effective surface at the back, in order to close opening 19 of chamber 20 so that no more flow medium can reach chamber 20 from flow medium inlet 7, the chamber being evacuated by flow medium pipe 28. At the same time disk 12 moves from the open position indicated in the drawing by dot-dash lines into the closed position shown by unbroken lines, due to the effect of pressure spring 13 and differential piston 14 with its accordingly arranged effective surfaces 14' and 14'' of different sizes. Disk 12 thus reliably guarantees a back valve function.

In order to switch the valve over from the closed state into the open state, electromagnetic 4-way valve 31 is switched back into the switch position shown on the left in the drawing, so that chamber 15 of step piston 11 is evacuated via flow medium pipe 27 and chamber 20 of the valve is acted upon via flow medium pipe 28 by flow medium from flow medium inlet 7 of the valve. Step piston 11 is displaced to the left in the drawing, in order to clear opening 19 of chamber 20, so that flow medium can flow in from flow medium inlet 7. Disk 12 rises from conical seating 21 of sheath 5 and is moved into the open position indicated in the drawing by dot-dash lines.

I claim:

1. A valve for supplying a flow medium to a flow medium pipe which alternatingly carries different flow media, in particular to the flow medium pipe of a converter for treating the contents of the converter with various gaseous flow media, characterized in that (a) a chamber is provided between a flow medium inlet and a flow medium outlet, which (b) may be closed by a piston on the side facing the flow medium inlet and (c) closed by a disk on the side facing the flow medium outlet, (d) the piston on the side turned away from the chamber and the chamber are each optionally connectable via a separate flow medium pipe with the flow medium inlet and the free atmosphere, respectively, to close the chamber by the piston and evacuate the chamber, or with the free atmosphere and the flow medium inlet, respectively, to open the chamber by the piston, (e) the disk being loaded in a closed position towards the chamber by a spring and a differential piston with a larger effective surface on the side facing the flow medium outlet and a smaller effective surface on the opposite side.

2. A valve as in claim 1, characterized in that the piston on the side turned away from the chamber has a larger diameter than that of an opening in the chamber which the piston blocks when the chamber is closed by the piston.

3. A valve as in claim 2, characterized in that the differential piston extends through a housing provided in the middle of the chamber, which housing accommodates the spring and the inside of which communicates with the free atmosphere.

4. A valve as in claim 3, characterized in that two flow medium pipes leading to the piston and into the chamber, respectively, are connected to the two outflows of an electromagnetic 4-way valve, respectively, which two inflows communicate with the flow medium inlet and with the free atmosphere, respectively.

5. A valve as in claim 4, characterized in that the chamber, the piston, the disk, and the differential piston provided on the latter are arranged coaxially to each other and to the flow medium outlet, while the flow medium inlet is arranged perpendicularly.

6. A valve as in claim 2, characterized in that two flow medium pipes leading to the piston and into the chamber, respectively, are connected to the two outflows of an electromagnetic 4-way valve, respectively, which two inflows communicate with the flow medium inlet and with the free atmosphere, respectively.

7. A valve as in claim 6, characterized in that the chamber, the piston, the disk, and the differential piston provided on the latter are arranged coaxially to each other and to the flow medium outlet, while the flow medium inlet is arranged perpendicularly.

8. A valve as in claim 2, characterized in that the chamber, the piston, the disk, and the differential piston provided on the latter are arranged coaxially to each other and to the flow medium outlet, while the flow medium inlet is arranged perpendicularly.

9. A valve as in claim 3, characterized in that the chamber, the piston, the disk, and the differential piston provided on the latter are arranged coaxially to each other and to the flow medium outlet, while the flow medium inlet is arranged perpendicularly.

10. A valve as in claim 1, characterized in that the differential piston extends through a housing provided in the middle of the chamber, which housing accommodates the spring and the inside of which communicates with the free atmosphere.

11. A valve as in claim 10, characterized in that two flow medium pipes leading to the piston and into the chamber, respectively, are connected to the two outflows of an electromagnetic 4-way valve, respectively, which two inflows communicate with the flow medium inlet and with the free atmosphere, respectively.

12. A valve as in claim 11, characterized in that the chamber, the piston, the disk, and the differential piston provided on the latter are arranged coaxially to each other and to the flow medium outlet, while the flow medium inlet is arranged perpendicularly.

13. A valve as in claim 10, characterized in that the chamber, the piston, the disk, and the differential piston provided on the latter are arranged coaxially to each other and to the flow medium outlet, while the flow medium inlet is arranged perpendicularly.

14. A valve as in claim 1, characterized in that two flow medium pipes leading to the piston and into the chamber, respectively, are connected to the two outflows of an electromagnetic 4-way valve, respectively, which two inflows communicate with the fow medium inlet and with the free atmosphere, respectively.

15. A valve as in claim 14, characterized in that the chamber, the piston, the disk, and the differential piston provided on the latter are arranged coaxially to each other and to the flow medium outlet, while the flow medium inlet is arranged perpendicularly.

16. A valve as in claim 1, characterized in that the chamber, the piston, the disk, and the differential piston provided on the latter are arranged coaxially to each other and to the flow medium outlet, while the flow medium inlet is arranged perpendicularly.

* * * * *